United States Patent [19]

Johnson

[11] Patent Number: 4,796,387

[45] Date of Patent: Jan. 10, 1989

[54] MICRO-ABRASIVE FINISHING DEVICE

[76] Inventor: James N. Johnson, P.O. Box 2747, Youngstown, Ohio 44507

[21] Appl. No.: 122,755

[22] Filed: Nov. 19, 1987

[51] Int. Cl.[4] ..... B24B 7/00; B24B 21/00

[52] U.S. Cl. ..... 51/62; 51/141; 51/150

[58] Field of Search ..... 51/62, 135 R, 145 R, 51/150, 154, 141

[56] References Cited

U.S. PATENT DOCUMENTS 4,292,767 10/1981 Fatula ..... 51/145 R
4,316,349 2/1982 Nelson ..... 51/135 R
4,575,972 3/1986 Ohki et al. ..... 51/135 R
4,682,444 7/1987 Judge et al. ..... 51/141

*Primary Examiner*—John K. Corbin
*Assistant Examiner*—Jay Ryan
*Attorney, Agent, or Firm*—Harpman & Harpman

[57] ABSTRACT

A micro-abrasive finishing device to polish flat, curved or irregular surfaces to exceedingly high tolerances required for a variety of finishing rolls or the like currently used in industry to finish various materials. The finishing device utilizes micro-abrasives to their fullest potential by varying oscillation and relative speed at which the abrasive contacts the surface to be finished.

6 Claims, 4 Drawing Sheets

MICRO-ABRASIVE FINISHING DEVICE

BACKGROUND OF THE INVENTION

1. Technical Field

This device relates to grinding machines that are used to grind cylindrical or rolling surfaces of a work roll on a rolling mill and other finishing rolls by incrementally advancing an abrasive belt over a platen movably engaged against the roll. This refinishing of work rolls is required as the rolls become worn and roughened during use. Conventionally the rolls are removed for grinding or are ground in their mounted position greatly reducing down time required for refinishing.

2. Description of Prior Art

Prior art devices of this type have relied on a variety of different structures to support and advance abrasive belts about a fixed point at variable speeds, see for example U.S. Pat. No. 2,810,480,U.S. Pat. No. 3,665,649, U.S. Pat. No. 4,292,767, U.S. Pat. No. 4,316,349 and U.S. Pat. No. 4,575,972.

In U.S. Pat. No. 2,810,480 a continuous abrasive belt is positioned against a flat work piece with variable tension. The belt travels in a single, continuous direction.

U.S. Pat. No. 3,665,649 discloses an endless grinding belt that can be positioned against a rod to grind and polish same.

U.S. Pat. No. 4,292,767 shows a belt grinder for a non-circular work piece rotating on its longitudinal axis. The relative pressure on the non-round work piece is required to be varied for maintaining even pressure and proper required finish. This device varies the pressure via a fluid motor advancing a cylinder according to a predetermined work piece shape requirement.

U.S. Pat. No. 4,316,349 discloses a portable abrasive belt finisher that uses a continuous abrasive belt supported by three rollers driven by a single drive motor.

U.S. Pat. No. 4,575,972 shows a portable grinding machine for use on rolling mills. The device uses a variable force against a pressure member engaging the abrasive belt traveling over. A load cell varies the force imparted against the pressure member by a pair of hydraulic piston and cylinder assemblies innerconnected to a spring loaded plunger that engages the pressure surface.

SUMMARY OF THE INVENTION

A micro-abrasive finishing device that is used to finish and polish work rolls or the like in rolling mills. The finishing device uses pre-manufactured coated abrasives on a plastic film backing having a variety of precisely grated grits. The coated abrasive is dispensed and positioned over a work engageable platen that oscillates at selected frequency oscillation combined with adjustable platen pressure and controlled advancement and retrieval of the coated abrasive within a self-contained lightweight portable configuration. The micro-abrasive finishing device can be adapted to a variety of different finishing and grinding applications by modifications of associated support transport structures.

DESCRIPTION OF THE PREFERRED EMBODIMENT

Figure 1:
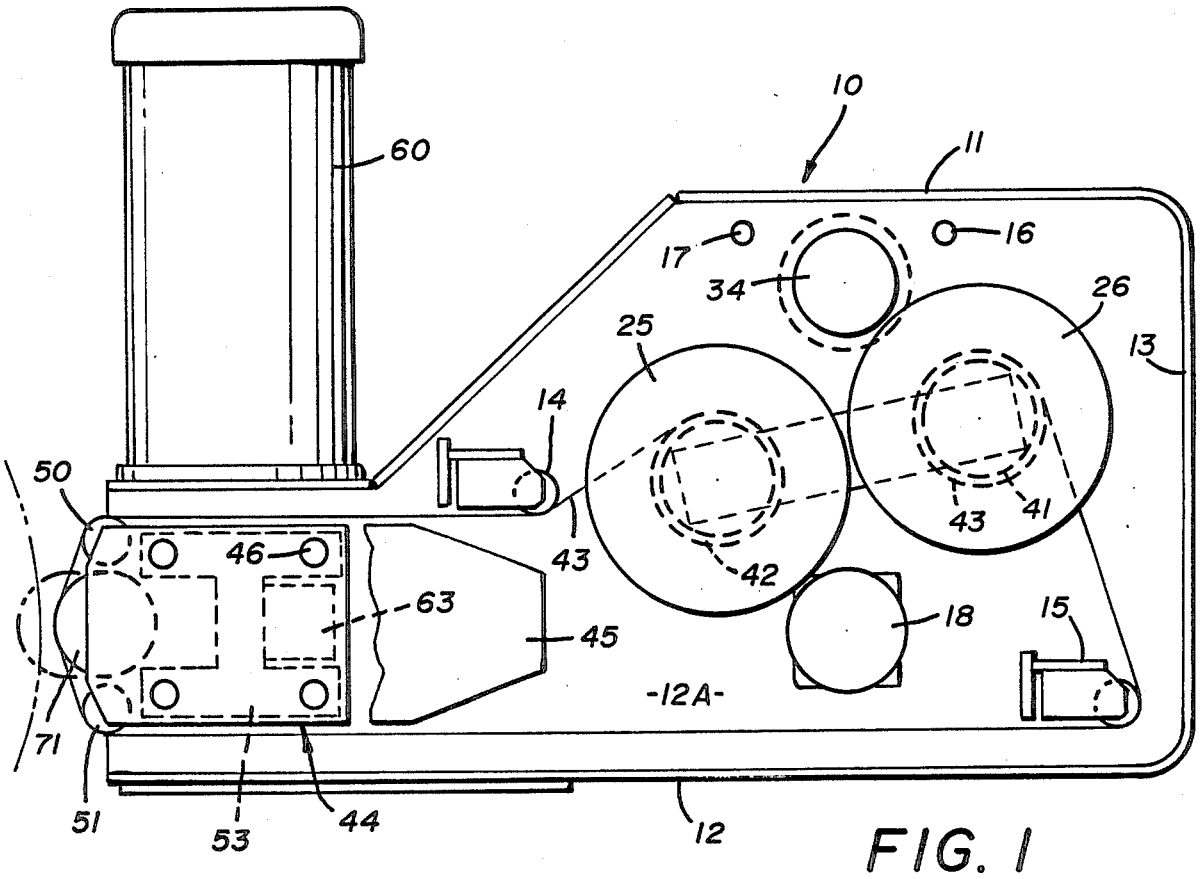
FIG. 1 is a side plan view of the finishing device with a coated abrasive cassette installed.
Figure 2:
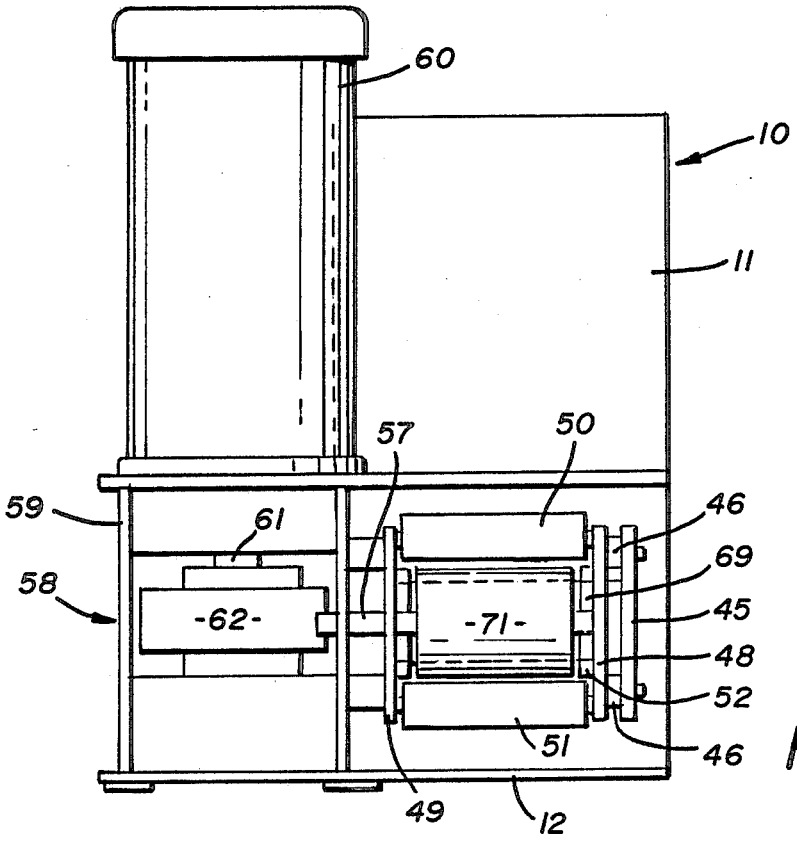
FIG. 2 is an end plan view of the finishing device detailing the work engagement portion thereof.
Figure 10:
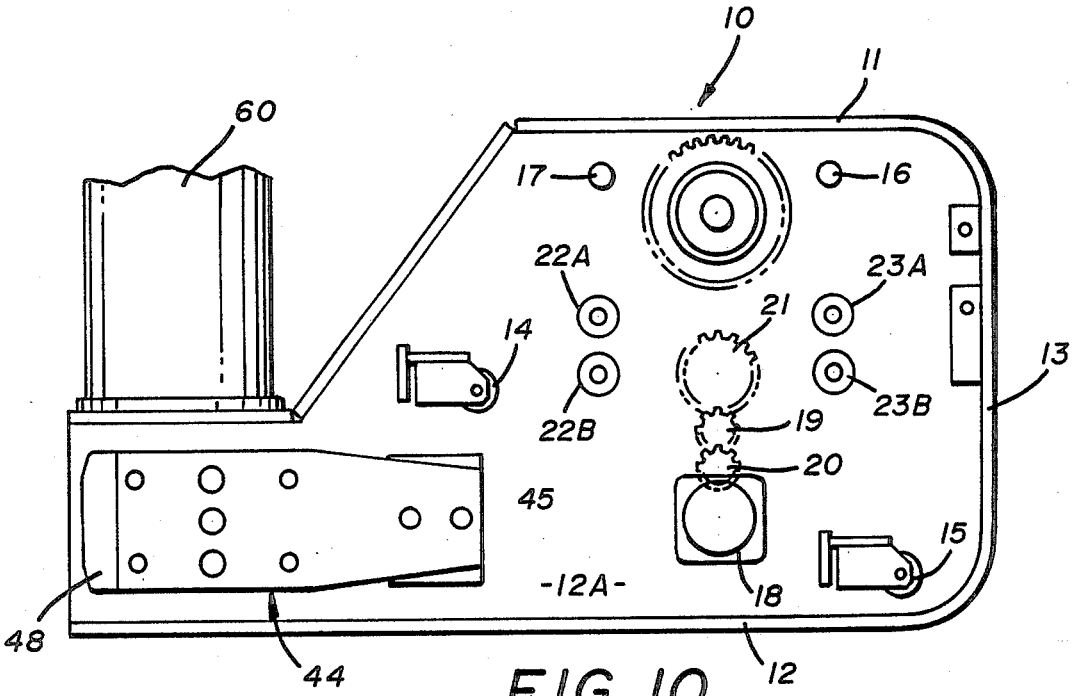
FIG. 10 is a side plan view of the finishing device with coated abrasive cassette removed.

Referring now to FIGS. 1, 2 and 10 of the drawings a finishing device can be seen comprising a multiple sided housing 10 having a top and bottom 11 and 12, a side panel 12A and end panel 13 therebetween. Secured within the housing 10 are multiple guide rollers 14 and 15 and their associated mounts and a pair of guide pins 16 and 17.

A variable speed DC drive motor 18 is secured adjacent said guide roller 15. A pair of gear train drive gears 19 and 20 (shown in broken lines in FIG. 10 of the drawings) interconnect the DC drive motor 18 with a main drive gear 21 positioned just above said motor 18.

Figure 11:
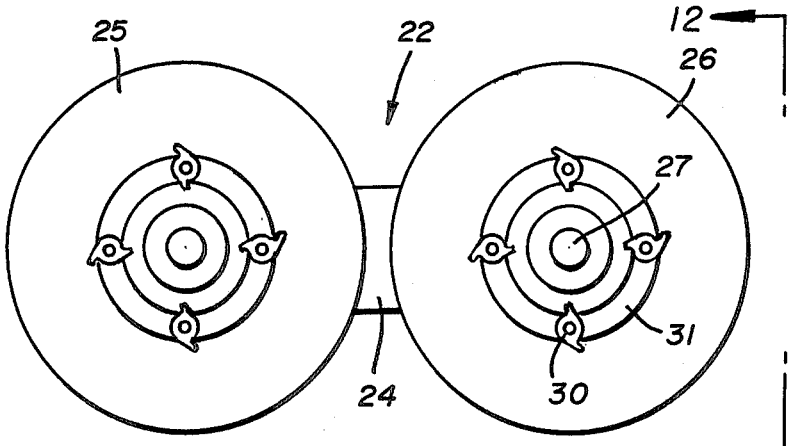
FIG. 11 is a side plan view of the coated abrasive cassette.
Figure 12:
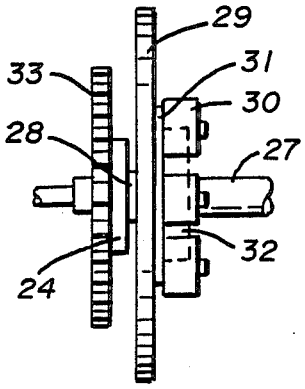
FIG. 12 is an end plan view on lines 12—12 of FIG. 11.
Figure 13:
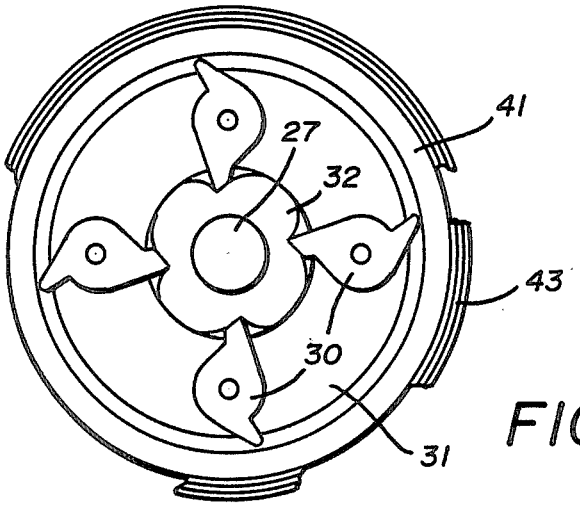
FIG. 13 is an enlarged view of a portion of the coated abrasive cassette of FIG. 11.

An abrasive cassette, best seen in FIGS. 1, 11, and 12 of the drawings is positioned on the housing 10 registering within pairs of oppositely disposed vertical aligned bearing bores 22 A and B and 23 A and B. The abrasive cassette comprises a rectangular support bar 24 with two identical abrasive spool support assemblies 25 and 26 in spaced relation thereon. Each abrasive spool assembly is comprised of a shaft 27 extending through said support bar 24. A spacer 28, and spool engagement disk 29 are positioned on said shaft 27. A plurality of annularly spaced eccentric dogs 30 are pivotally secured to a mounting plate 31 on the spool engagement disk 29. A urethane spring 32 is positioned around the shaft 27 on the mounting plate 31 and is engageable by said eccentric dogs 30, best seen in FIG. 13 of the drawings. An engagement gear 33 is secured to the shaft 27 on the opposite side of said support bar 24.

Figure 14:
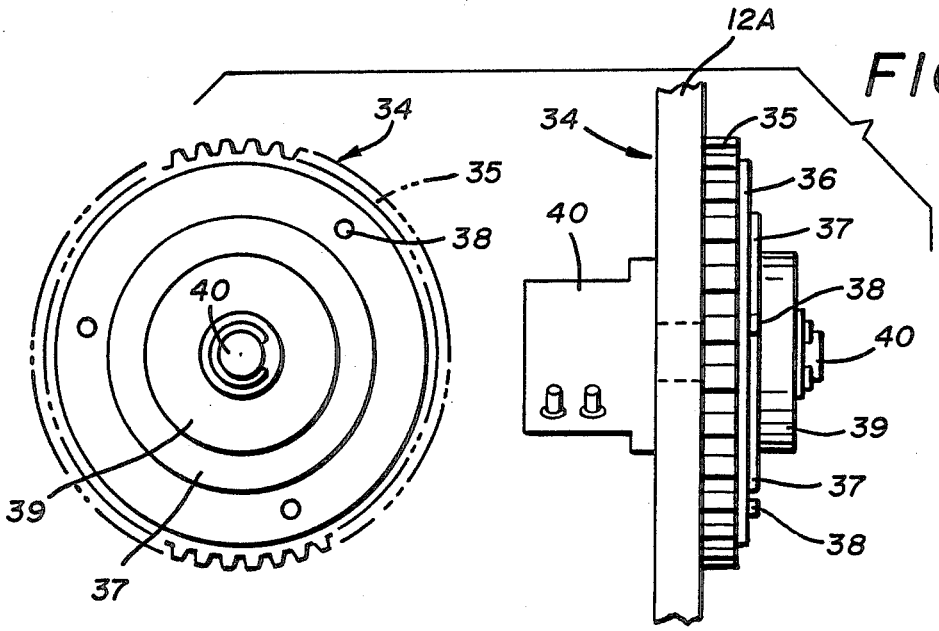
FIG. 14 is a side and end view of a clutch assembly selectively engageable on the coated abrasive cassette.

A clutch 34 is positioned on the housing 10 between said guide pins 16 and 17 and is comprised of a clutch gear 35, a fixed and rotating frictional pads 36 and 37. A plurality of drive pins 38 interconnecting said rotating friction pads 37 with said clutch gear 35 and a pressure hub 39 is selectively engageable on said fixed friction pad 36 by an air cylinder assembly 40, best seen in FIG. 14 of the drawings.

In operation the abrasive cassette shafts 27 are positioned in oppositely disposed angularly aligned bores 22B and 23A respectively as seen in FIG. 1 of the drawings with respective engagement of the associated drive gear 21 with the abrasive spool assembly 25 and conversely the engagement of the abrasive spool assembly 26 via the engagement gear 33 with the clutch gear 35.

An abrasive spool 41 is pre-positioned on the abrasive spool assembly 26 with a take up abrasive spool 42 on the abrasive spool assembly 25. The abrasive spool 41 has a wound band 43 of coated micro-abrasive material thereon supplied by 3M Company which includes a multiple micron graded and coated abrasive in a single layer on a plastic film. The abrasive spool 41 in this embodiment is engaged and held by the eccentric dogs 30 for movement in one direction as will be understood by those skilled in the art.

The abrasive band 43 is dispensed from the abrasive spool 41 traveling over the guide roller 15 and into a oscillating head assembly 44, best seen in FIGS. 1, 2, 3, 4, 5 and 6 of the drawings.

Figure 3:
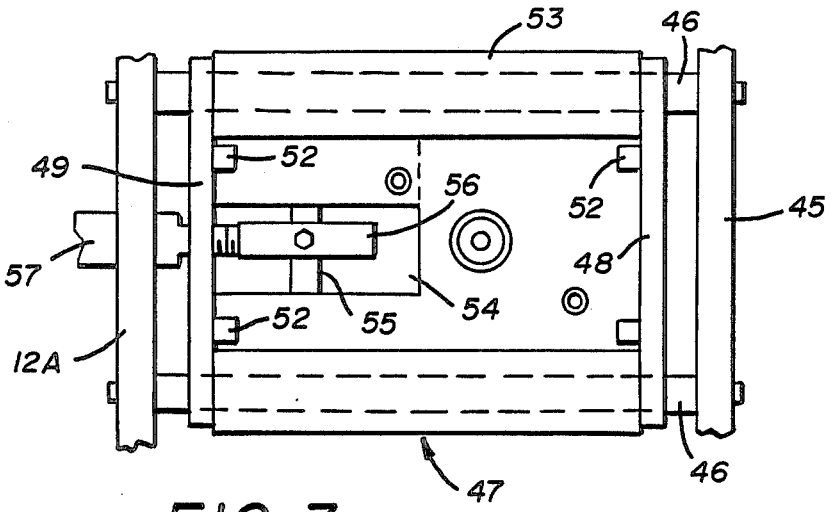
FIG. 3 is an end plan view of the oscillation head.
Figure 4:
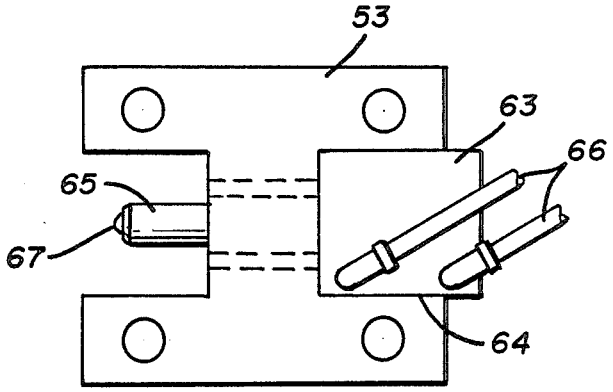
FIG. 4 is a side plan view of the oscillation head in FIG. 3 of the drawings.
Figure 5:
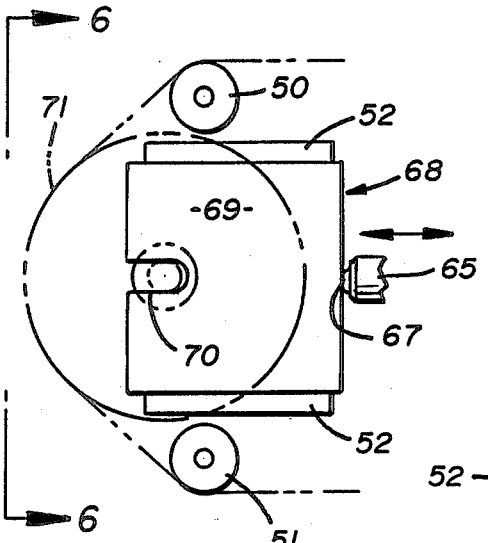
FIG. 5 is a side plan view of a mounted platen and associated guide rollers with a coated abrasive position thereon.
Figure 6:
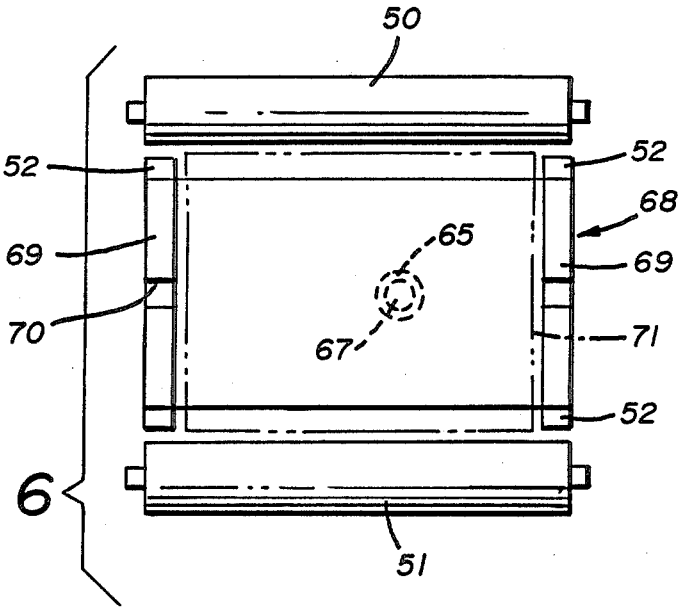
FIG. 6 is an end plan view on lines 6—6 of FIG. 5.

The oscillating head assembly 44 is made up of a fixed mounting plate 45 which is secured in spaced relation to said side panel 12A. Pairs of spaced, oppositely disposed fixed rods 46 extend between said mounting plate 45 and the side panel 12A have a oscillating head 47 movably positioned thereon as best seen in FIGS. 3 and 4 of the drawings. The oscillating head 47 has spaced apertures side plates 48 and 49 with rollers 50 and 51 therebetween adjacent one end thereof. A pair of spaced guide bars 52 are secured to each of the apertured side plates 48 and 49 in oppositely diposed relation to one another adjacent each of the rollers 50 and 51. A nylon head insert 53 is positioned on the fixed rods 46 and has a generally H-shaped configuration as best seen in FIG. 4 of the drawings. The nylon head insert 53 is of a high molecular weight, oil impregnated material forming its own bearing surfaces on the fixed rods 46. A notch is formed in the web portion of the nylon insert at 54 having an engagement rod 55 extending therethrough. A connecting link 56 is positioned around said engagement rod 55 and is threadably secured to a connecting shaft 57 extending therefrom.

An oscillation bearing assembly 58 is secured within a bearing housing 59 having the common side plate 12A with the housing 10. A electric motor 60 is secured above the bearing housing 59 and has an eccentric drive shaft 61 extending therefrom as best seen in FIG. 2 of the drawings. The electric motor 60 is connected to a power source (not shown). The eccentric drive shaft 61 oscillates a middle bearing 62 having the connecting shaft 57 extending therefrom.

Referring now to FIGS. 3 and 4 of the drawings, an infeed air cylinder 63 is secured to the nylon insert 53 with a piston 64 extending through said insert adjacent said notch. The infeed cylinder has supply lines and fittings 66 extending therefrom to a fluid pump (not shown). A button head bolt 67 is positioned in the free end of said infeed piston 65 for engagement with head support yoke 68, best seen in FIGS. 5 and 6 of the drawings.

The head support yoke 68 is bifurcated defining oppositely disposed spaced support arms 69 having an elongated opening 70 with spaced parallel walls within each arm. The head support yoke 68 is positioned between the spaced apertured side plates 48 and 49 by interference fit between the yoke 68 and the guide bars 52. A cylindrical platen 71 is mounted on its central axis within the elongated opening 70 in the yoke 68. The cylindrical platen 70 can be of different densities dependent on the required finish and work piece to which it will be applied.

The abrasive band 43 passes over the roller 51 the platen 71 and the roller 50 exiting the oscillation head assembly 44. The guide roller 14 engages the abrasive band 43 and positions same for rewinding on the take up abrasive spool 42, best seen in FIG. 1 of the drawings.

Figure 7:
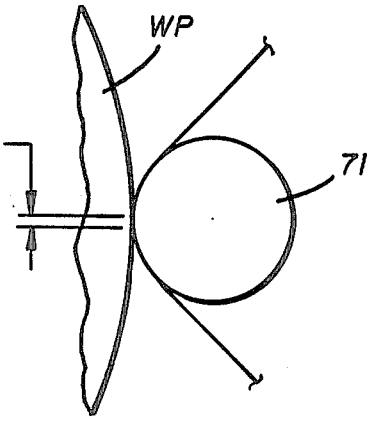
FIG. 7 is a graphic representation of a contoured work piece engaged by the finishing device.
Figure 8:
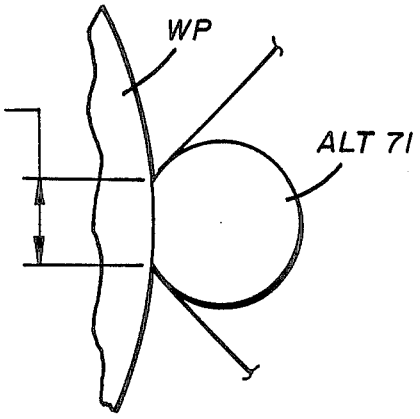
FIG. 8 is a graphic representation of a uniform work piece engaged by the finishing device.

It will be evident from the above description that the nylon head insert 53 within the oscillating head assembly 44 will oscillate side to side on the fixed rods 46 and that the oscillation is variable in relation to amplitude and frequency by the variation of speed of the eccentric drive shaft 61 and associated bearings 62 in combination with the advancement of the abrasive band 43 over the platen 70 defining an infinite number of abrasive scratch patterns on the work piece. The infeed pressure on the platen 71 and accordingly on the work piece is variable via the infeed air cylinder 63 and piston 65 engaging the yoke 68 advancing same with the platen 71 against the work piece, as best seen in FIG. 7 and 8 of the drawings. In FIG. 7 of the drawings a hard composite platen 71 is shown engaging a curved work piece while in FIG. 8 of the drawings an alternate soft composite platen ALT 71 is shown deflecting upon engagement of a curved work piece.

Figure 9:
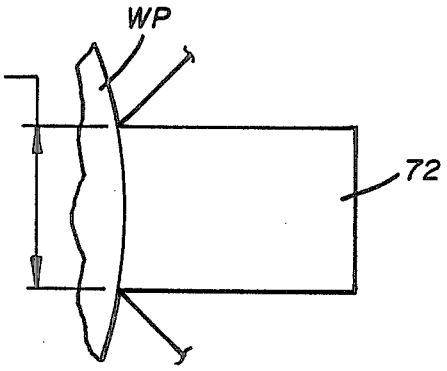
FIG. 9 is a graphic representation of a uniform work piece engaged by a modified platen.

A square platen 72 is shown in FIG. 9 of the drawings advancing against a work piece. The square platen 72 can be used in place of the cylindrical platen 71 if required for different finishing applications.

Since the abrasive band 43 and platen 71 are pneumatically preloaded against the work piece the abrasive band 43 will follow irregular surfaces, such as curved rolls or rolls that do not run round. This allows the finishing device to be mounted on old inaccurate inexpensive machines and still generate high quality finishes which are required.

In operation the abrasive cassette can be changed with a preload abrasive cassette having a different grade of micro-abrasive easily and quickly allowing for multiple abrasive grade changes in a finishing sequence which may be required on a certain work piece.

It is evident that the direction of the abrasive travel is reversible by mounting the cassette in the alternate position to that of which is described above which may be required in certain instances.

By utilizing roller platens 71 of different hardnesses, varied effects can be achieved, such as a hard roller platen will make the abrasive function as a homing device and flatten out the surface of the work piece, thus providing rapid elimination of chatter and traverse marks generated by previous manufacturing operations. The use of soft platen 71 will deflect more than hard ones and provide increased contact area with the work piece, thus proportionally increasing the amount of work done simultaneously reducing the pressure per grain and scratch depth of any particular size of abrasive. Assuming the front head is accessible, the platens can be changed very rapidly.

Thus it will be seen that a new and useful micro-abrasive finishing device has been illustrated and described and that various changes and modifications may be made therein without departing from the spirit of the invention.

Therefore I claim:

1. A micro-abrasive finishing device used to finish work pieces of different configuration comprises in combination, a housing having multiple sides a bottom and a top, a removable interchangeable abrasive cassette mounted within said housing, said abrasive cassette comprises a pair of abrasive spool assemblies, an abrasive spool with an abrasive band of micro-abrasive material positioned on at least one of said abrasive spool assemblies, an oscillating head assembly within said housing, a plurality of guide rollers within said housing aligned to guide said abrasive band into said oscillating head assembly, said oscillating head assembly comprises in combination an independent fixed mounting plate, a plurality of spaced, fixed rods extending between said fixed mounting plate and said housing, a nylon head insert movably positioned on said rods, means for oscillating said head insert, means for selectively driving one of said abrasive spool assemblies, a yoke adjustably positioned in said nylon insert, a platen positioned in said yoke, means for adjustably positioning said yoke in said nylon head insert, means for restrictive, selective, directional rotation of said abrasive spool on said abrasive spool assemblies, means for adjustably maintaining tension on said abrasive band.

2. The micro-abrasive finishing device of claim 1 wherein said means for oscillating said head insert comprises an eccentric drive shaft engaging through a middle bearing having a connecting shaft engaging said nylon head insert.

3. The micro-abrasive finishing device of claim 1 wherein said means for selectively driving one of said abrasive spool assemblies comprises a variable speed DC motor connected to a power source and multiple drive gears.

4. The micro-abrasive finishing device of claim 1 wherein said means for adjustably positioning said yoke in said nylon head insert comprises an inner feed piston and cylinder secured to and extending through said nylon head insert connected to a source of fluid pressure.

5. The micro-abrasive finishing device of claim 1 wherein said means for restrictively selecting directional rotation of said abrasive spool on said abrasive spool assemblies comprises a plurality of annularly spaced eccentric dogs engageable on a urethane spring.

6. The micro-abrasive finishing device of claim 1 wherein said means for adjustably maintaining tension on said abrasive band comprises a gear clutch engageable on one of said abrasive spool assemblies so gear clutch comprises a clutch gear, fixed and rotating friction pads, and a pressure hub having an air cylinder assembly interconnected to one another and to a source of fluid pressure for selective engagement of said pressure hub and said friction pads.

* * * * *